US006634871B2

(12) United States Patent
Ikuta

(10) Patent No.: US 6,634,871 B2
(45) Date of Patent: Oct. 21, 2003

(54) SUCTION-DISCHARGE DEVICE FOR FLUIDS COMPRISING A PISTON WITHIN A ROTATING INNER TUBE AND A PLURALITY OF SUCTION AND DISCHARGE HOLES

(76) Inventor: Kazumasa Ikuta, 5-1-301, Horiguchi, Kanagawa-Ku, Yokohama-shi, Kanagawa (JP)

( * ) Notice: Subject to any disclaimer, the term of this patent is extended or adjusted under 35 U.S.C. 154(b) by 0 days.

(21) Appl. No.: 09/977,210

(22) Filed: Oct. 16, 2001

(65) Prior Publication Data

US 2003/0039565 A1 Feb. 27, 2003

(30) Foreign Application Priority Data

Aug. 27, 2001 (JP) ..... 2001/256391

(51) Int. Cl.[7] ..... F04B 37/00

(52) U.S. Cl. ..... 417/466; 417/462; 417/493; 417/494; 417/510

(58) Field of Search ..... 417/461, 510, 417/515, 534, 535, 536, 466, 462, 493, 494

(56) References Cited

U.S. PATENT DOCUMENTS 2,079,119 A * 5/1937 Hillis ..... 417/462
3,823,697 A * 7/1974 Von Esch ..... 123/43 R
4,026,196 A * 5/1977 Olofsson ..... 92/140
4,074,667 A * 2/1978 Skinner ..... 123/502
4,660,522 A * 4/1987 Babitzka ..... 123/450
4,722,675 A * 2/1988 Albarda ..... 417/509
5,577,896 A * 11/1996 Harada ..... 417/259
5,613,839 A * 3/1997 Buckley ..... 417/273
5,666,921 A * 9/1997 Collingborn ..... 123/450

* cited by examiner

*Primary Examiner*—Charles G. Freay
*Assistant Examiner*—Emmanuel Sayoc
(74) *Attorney, Agent, or Firm*—Armstrong, Westerman & Hattori, LLP.

(57) ABSTRACT

An object of the present invention is to provide a suction-discharge device for fluids capable of sucking fluids continuously and discharging fluids continuously under fixed flow rate and pressure, without substantially bringing about pulsations of even one unit. The device comprising a device body having a fitting hole and set comprising a suction hole and a discharge hole, an inner tube fitted rotatably in the fitting hole of the device body, a piston fitted slidably in said inner tube, and a plurality of through-holes formed in said inner tube, said through-holes of said inner tube each being a slot which is long in a rotational direction and inclined with respect to an axis of the inner tube, the suction hole and the discharge hole of said device body each being a slot which can partially overlap with said through-hole wherein when one of the through-holes of said inner tube communicates with the suction hole of said device body, the other through-hole of the inner tube communicates with a discharge hole of said device body, and when a fluid is sucked from the communicated suction hole said fluid is discharged from the communicated discharge hole.

14 Claims, 5 Drawing Sheets

SUCTION-DISCHARGE DEVICE FOR FLUIDS COMPRISING A PISTON WITHIN A ROTATING INNER TUBE AND A PLURALITY OF SUCTION AND DISCHARGE HOLES

BACKGROUND OF THE INVENTION

1. Field of the Invention

This invention relates to a suction-discharge device for fluids that can be used as a multiple purpose pump as well as a compressor, and more specifically, the invention relates to a suction-discharge device for fluids using a rotary valve capable of continuously sucking and discharging fluids without occurrence of pulsations.

2. Related Art

In the past, in the vacuum pump which exhausts and reduces in pressure in the device, during the reciprocation of a piston, when pushing, pressure buildups while when pulling, pressure does not buildup, thus resulting in a drawback in which pulsations are violently generated.

Further, in a conventional high pressure pump used as a boiler feed water pump or the like, a piston is used for a pump (a plunger pump), thus likewise resulting in a drawback in which outlet pressure buildups pulsations. Because of such pulsations as described, a pointer of a pressure gauge for measuring outlet pressure oscillates up and down, and therefore, presently, a damage preventive means is mounted on the pressure gauge.

For solving such problems as noted above, the present applicant has developed a suction-discharge device for fluids capable of continuously ducking and continuously discharging fluids without substantially bringing about pulsations, and has filed for a patent application previously (Japanese Patent Application No. 20001-117455).

The aforementioned suction-discharge device (a rotary piston pump) was extremely epochal in that a fixed flow rate of fluids can be sucked and discharged continuously without substantially bringing about pulsations by rotation of a rotary valve.

However, in the aforementioned suction-discharge device, when an inner valve rotates from 0° to 180°, the size of an opening becomes large gradually till 90°, and thereafter becomes small gradually, as shown in FIG. 1, and therefore, an outlet waveform is an crown sine curve as shown in FIG. 1, thus posing a problem that pulsations are brought about. It is noted that if two devices are used, and rotated with 90° deviated, it is possible to always suck a fixed quantity and discharge a fixed quantity, thus enabling prevention of pulsations.

SUMMARY OF THE INVENTION

It is an object of this invention to provide a suction-discharge device for fluids capable of, without substantially bringing about pulsations even one unit, sucking continuously and discharging continuously under fixed flow rate and pressure.

It is a further object of this invention to provide a suction-discharge device for fluids in which a fluid quantity to be sucked and discharged is made to be fixed.

It is another object of this invention to provide a suction-discharge device for fluids capable of eliminating leakage of fluids almost completely.

For achieving the aforementioned objects, according to this invention, there is provided a suction-discharge device for fluids, comprising an inner tube fitted rotatably in a fitting hole of a device body, a cylinder fitted slidably in said inner tube, and a plurality of through-holes formed in said inner tube, wherein when one of the through-holes of said inner tube comes into communication with a suction hole of said device body, the other through-hole of the inner tube comes into communication with a discharge hole of said device body, and when a fluid is sucked from the suction hole communicated, the fluid is discharged from the discharge hole communicated, through-hole of said inner tube being formed into a slot which is long in a rotational direction and inclined, the suction hole and the discharge hole of said device body being formed into a slot to be crossed with said through-hole.

In short, the present invention has found out that the cause that if a normal slot is formed, a quantity of fluids to be sucked and discharged indicates a sine curve results from the fact that an opening of a suction port and a discharged port communicated indicates a sine curve, and provides the subject matter that the suction hole and the discharge hole communicated are made to be the fixed size always to thereby eliminate pulsations substantially.

Preferably, the through-hole of the inner tube, and the suction hole and the discharge hole of the device body may be formed so that the suction hole and the discharge hole communicated are moved in a moving direction of the cylinder.

Preferably, the plurality of through-holes of the inner tube, and the suction hole and the discharge hole of the device body in contact with the through-hole have the same shape and same size, and are inclined from 30° to 60°, particularly, approximately 45°.

Preferably, a plurality of sets, each set of which comprises a suction hole and a discharge hole of the device body, are formed, and the set of a suction hole and a discharge hole may be communicated with the same through-hole of the inner tube and inclined in the same direction.

Preferably, with respect to the set of a suction hole and a discharge hole of the device body, the other is positioned at a position rotated by 180° of the inner tube from one.

Preferably, the cylinder is reciprocated in association with the rotation of the inner tube.

The device body will suffice to have a fitting hole, and is not particularly limited, but generally, a block body having an outer tube or a fitting hole is used.

Preferably, the through-hole of the inner tube is formed to be inclined in the same direction to surfaces opposite to each other (the other is positioned at a position rotated by 180° of the inner tube from one) and both lengthwise sides at a position apart in the sliding direction of the cylinder.

Preferably, the circumferential length of the slot of the inner tube, and the suction hole and the discharge hole of the device body is formed to be an arched slot of approximately 90°.

The above and other objects and advantages of the invention will become more apparent from the following description.

DETAILED DESCRIPTION OF THE PREFERRED EMBODIMENT

The embodiments of the present invention will be described hereinafter with reference to the drawings.

Figure 1:
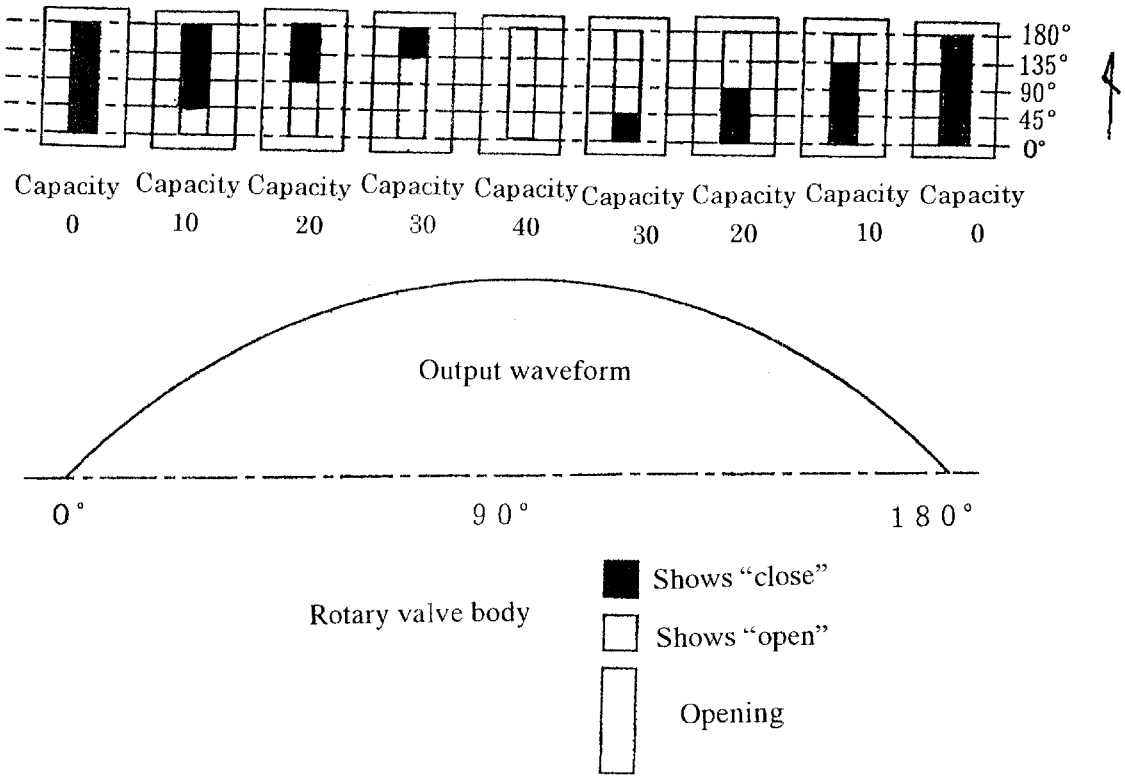
FIG. 1 is a diagram showing a waveform of a quantity of fluids sucked and discharged by fluids in a case where a slot is formed in an inner tube.
Figure 2:
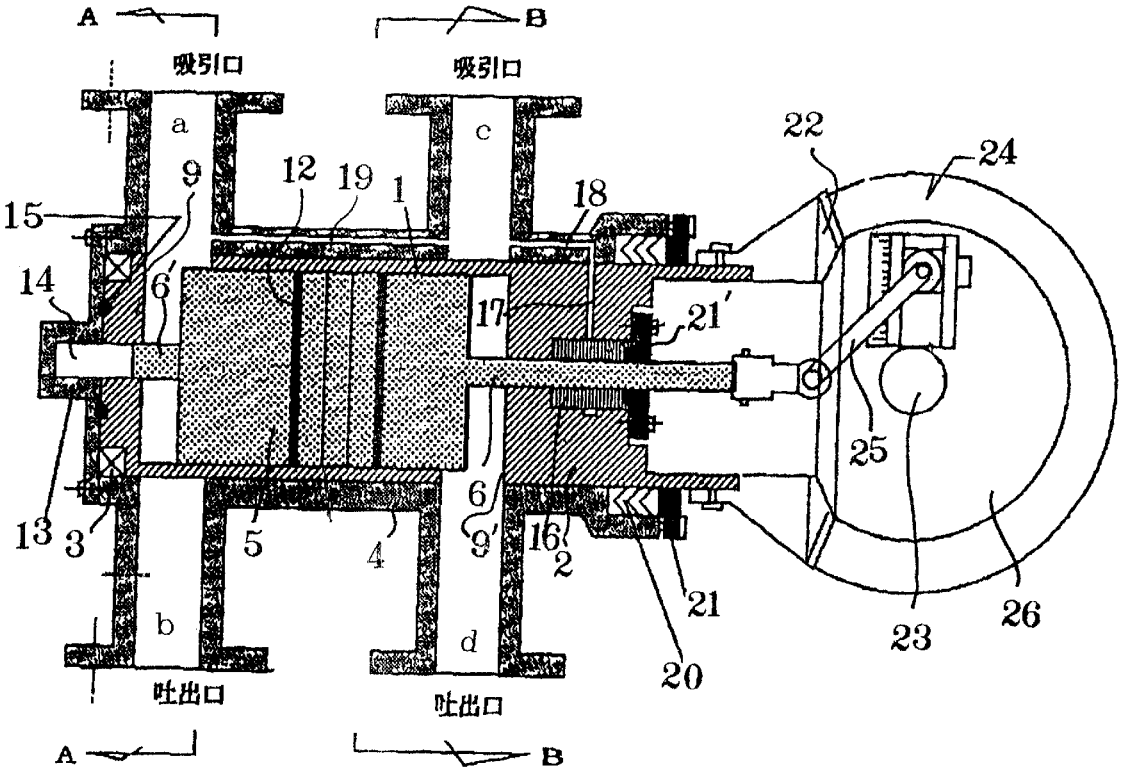
FIG. 2 is a sectional view showing one embodiment of the present invention.

FIG. 2 shows an embodiment of the present invention. A packing portion (a gland packing) 2 is connected at the rear of an inner tube 1, and is fitted rotatably in an outer tube 4 through a bearing 3. It is noted that the inner tube 1 and the packing portion 2 are formed integrally of metal or an alloy.

A cylinder (a piston body) 5 is fitted slidably in the inner tube 1, and a piston shaft 6 connected to the cylinder 5 is fitted rotatably in a fitting hole of the packing portion 2 of the inner tube 1.

Figure 3:
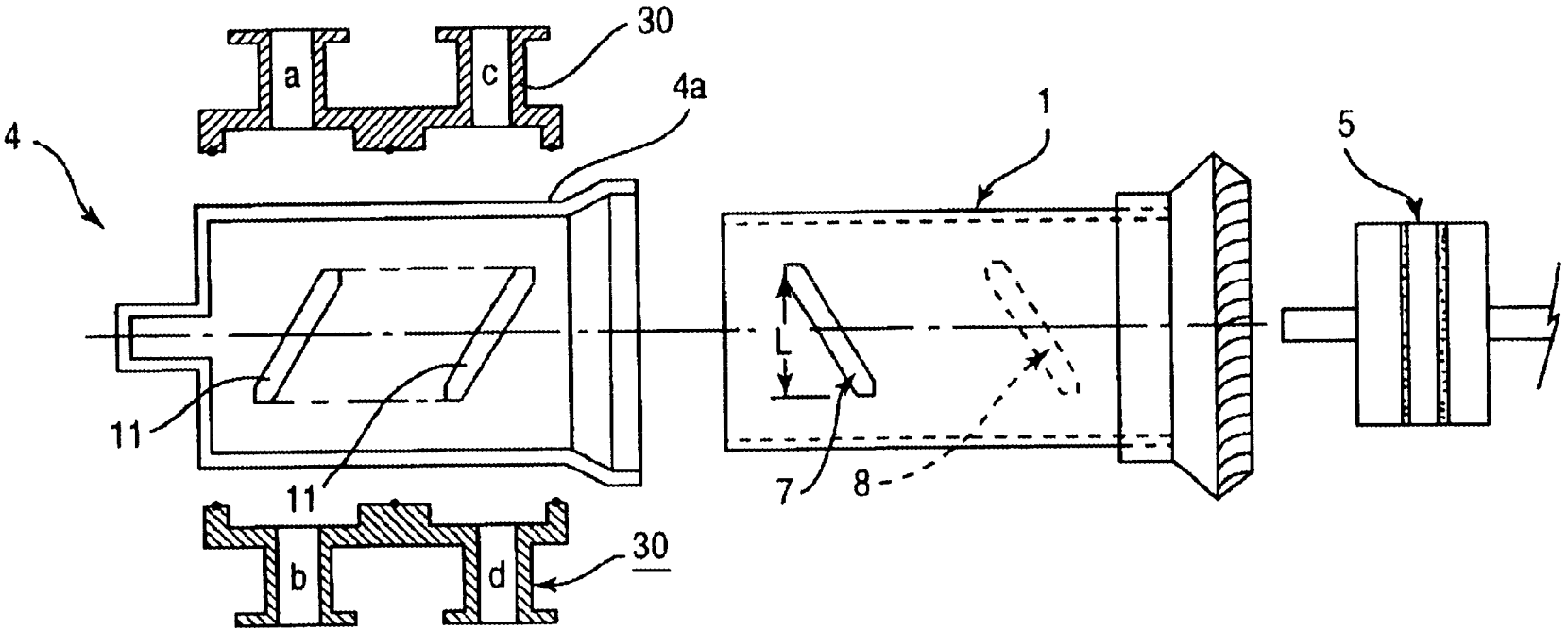
FIG. 3 is an exploded sectional view (partly a sectional view) showing one embodiment of the present invention.

Arched (90°) through-holes 7 and 8 which are long in a rotational direction and inclined are formed, as shown in FIG. 3, on both sides of the inner tube 1. Both the through-holes (slots) 7 and 8 have the same shape and the same size and are formed adjacent to or in proximity of both side walls 9 and 9' of the inner tube, and positioned parallel with each other on surfaces (parts rotated by 180°) opposite to each other and parts apart in the sliding direction of the piston.

Both the through-holes 7 and 8 are inclined by approximately 45°, and the circumferential length L is formed into an approximately 90° arched slot. The inclining direction may be either left or right in the rotational direction, and may be in the direction reversed to suction holes (discharge holes) 11,11 of the device body.

The device body is formed with the suction holes (discharge holes) 11,11 which have the same shape and the same size as the inclined slots 7, 8 and are inclined in the direction reversed to the slots 7, 8 and capable of being crossed with both the through-holes 7, 8. FIG. 3 shows the suction holes (or discharge holes) 11. At the superposed positions of the back are formed the discharge holes (or suction holes) which have the same shape and the same size and are inclined in the same direction.

An outer tube 4*a* is formed to be a square, which is held by a manipulator 30 to constitute the device body. The outer tube 4*a* may be separated from the manipulator 30 as described, or it is of course that they may be integrated.

The suction holes 11, 11 and the discharge holes of the outer tube 4*a* are formed at the position in contact with the fitting hole in which the inner tube is fitted, the suction holes 11, 11 are communicated with suction ports a, c, and the discharge holes 11, 11 are communicated with discharge ports b, d. It is noted of course that the shape of the outer tube 4*a* may be cylindrical or other shapes.

Being constituted as described above, when one of the through-holes 7 and 8 is communicated with the discharge hole b (or d) of the lower outer tube, the other is communicated with the suction hole c (or a) of the upper outer tube. Both the through-holes 7 and 8 have the same shape and the same size and are arranged in parallel, and the respective through-holes are symmetrical with respect to the central line lengthwise.

When the cylinder 5 is reciprocated in association with the rotation of the inner tube 1, and the one through-hole 7 (or 8) is communicated with the one suction hole a (or c) of the outer tube 4, the other through-hole 8 (or 7) is communicated with the discharge hole d (or b) of the outer tube 4 (4*a*), and when the fluid is sucked from the one communication hole, the fluid is discharged from the other communication hole. It is noted in the above-described embodiment that the suction holes and the discharge holes of the outer tube are formed in number of two (a and c, b and d), respectively. This is because of the reason that when one of the through-holes 7, 8 of the inner tube is communicated with the suction hole a (or c) of the outer tube, the other through-hole 7 or 8 of the inner tube is communicated with the discharge hole b (or d) of the outer tube. It is noted that the suction holes (a and c) and the discharge holes (b and d) may be communicated with each other, respectively.

The start position shown in FIG. 4(A) is a position (a rotary valve angle 0°) in which the piston is pressed to the extreme end in this figure. The suction holes a, c and the discharge holes b, d are closed. The figure shows that the suction hole a is in a state of the suction start, and the discharge hole d is in a state of the discharge start.

When the inner tube is rotated by 90°, the piston assumes a position moved back half, as shown in FIG. 4(B). Being the position from FIG. 4(A) to FIG. 4(B), the back opening 8 gradually rotates from 0° to 90° of rotational angle to assume a state of capacity 0 (left end of FIG. 5) to capacity 10 (center of FIG. 5). This state shows that fluids are discharged fixed by fixed amount. Fluids are sucked fixed by fixed amount from the surface opening 7. In FIG. 5, the black slot is a slot 11 of the outer tube, and the white portion is an opening (a communicated suction hole (or a discharge hole)) crossed with the slot 7 (or 8) of the inner tube and formed.

When the inner tube is further rotated by 90° (180° rotated position), there assumes a position in which the piston shown in FIG. 4(C) is pulled to the rear end, which is a momentarily switching position of the suction port-discharge port. The suction holes a, c and the discharge holes b, d are closed, in which the suction hole c is in a state of the suction start, and the discharge hole b is in a state of the discharge start. Being the position from FIG. 4(B) to FIG. 4(C), the back opening 8 gradually rotates from 90° to 180° to assume a state of capacity 10 of FIG. 5 (center of FIG. 5) to capacity 0 (right end). This state shows that fluids are discharged fixed by fixed amount.

Figure 4:
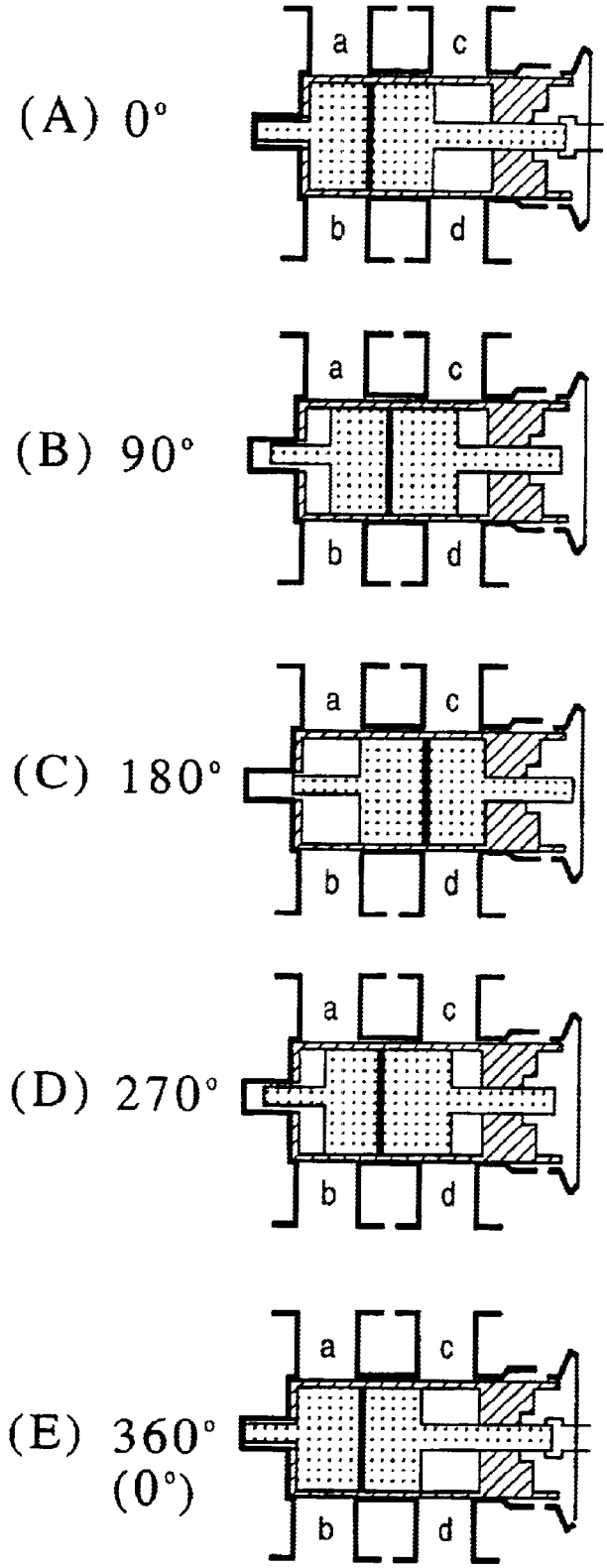
FIG. 4 is a sectional view for explaining the movement of a piston according to the present invention.
Figure 5:
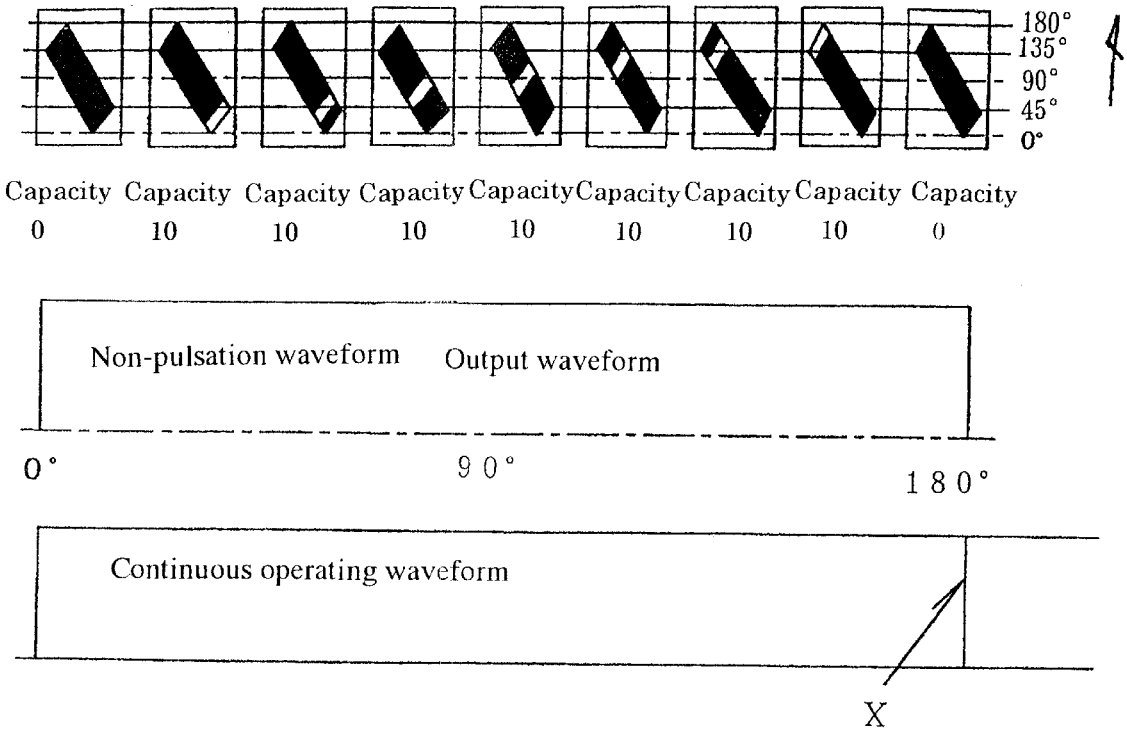
FIG. 5 is a diagram showing a suction hole and a discharge hole communicated of the device according to the present invention, and a waveform of fluids sucked and discharged.

When the inner tube is further rotated by 90° (270° rotated position), the piston assumes a position advanced half, as shown in FIG. 4(D). Being the position from FIG. 4(C) to FIG. 4 (D), the back opening 8 assumes a state of capacity 0 of FIG. 5 (right end) to capacity 10 (center of FIG. 5). This state shows that fluids are sucked fixed by fixed amount from the back opening 8. Fluids are discharged by fixed by fixed amount from the surface opening 7.

When the inner tube is further rotated by 90° (360° rotated position), the position is returned to the initial start position as shown in FIG. 4(E). That is, this position is a position in which the piston is pushed to the extreme end, which is a momentarily switching position of the suction port-discharge port. In this state, the suction holes a, c and the discharge holes b, d are closed, in which the suction hole a is in a state of the suction start, and the discharge hole d is in a state of the discharge start. Being the position from FIG. 4(D) to FIG. 4(E), the back opening 8 assumes a state of capacity 10 of FIG. 5 (center of FIG. 5) to capacity 0 (left end). This state shows that fluids are sucked fixed by fixed amount from the back opening 8.

FIG. 5 shows a waveform of a quantity of fluids that is sucked and discharged from the suction holes a, c and the discharge holes b, d. Since the sizes of the suction holes and discharge holes communicated (portions indicated by white in FIG. 5) are the same always when suction and discharge take place, as described above, an output waveform of one cycle is always constant even if a rotational angle changes, and a continuous operation waveform is also constant as shown in FIG. 5. This waveform indicates that no pulsations occurs. It is noted that the longitudinal line X of the continuous waveform is a waveform line that occurs momentarily when the rotational angle of the crankshaft is switched from 360° to 1°. Suppose that 1 cycle is 0.5 second, a switching position is about (1/500)×2 second, which is therefore substantially the same that a fixed quantity of fluids is sucked and discharged. It has been confirmed from experiments that pulsations are not brought about substantially.

While in the above-described embodiment, a description has been made of that the cylinder 5 comes in contact with both side walls 9, 9', it is to be noted that the cylinder does not come in contact with both side walls but may be reciprocated at an apart position.

A heat resistant and wear resistant oil seal 12 is fitted and mounted in the outer circumference of the cylinder 5. Accordingly, the cylinder may be reciprocated at high speeds under high temperature.

A piston shaft 6' is connected to the extreme end of the cylinder 5, and the piston shaft 6' is slidably fitted in a fitting hole 14 of a side wall projecting portion (a device cover) 13 of the inner tube 1. The device cover 13 is secured to the outer tube 4 by means of screws. The device cover 13 is in contact with the inner tube 1 through an O-ring 15.

Since the piston shaft 6' is connected to the extreme end of the cylinder 5 as described above, the volume of the chamber formed by contact of the cylinder 5 with the forward and backward side walls 9, 9' is the same whereby a fixed quantity of fluids can be sucked and a fixed quantity of fluids can be discharged always, thus enabling complete elimination of pulsations. It is noted that the piston shaft 6' may be constituted so that it is fitted into the cylinder 5 against the force of spring.

The piston shaft 6 is held slidably by the gland seal 16 of the gland packing 2, a ring-like passage is formed in the outer circumference of the gland seal 16, a passage 18 in communication with the suction holes a, c of the device body is provided through the ring-like passage and a passage 17, and the ring-like passage, the passage 17 and the passage 18 constitute a bypass passage. The suction hole a and the suction hole c are communicated with each other through the passage 19. A communication portion of the passage 18 with the passage 17 is formed to be ring-like.

The rear end of the gland packing 2 and the rear end of the outer tube 4 are placed in contact rotatably through a fluorine seal packing 20, and the seal packing 20 is pressed and held by a packing flange 21. The gland seal 16 is encased in the gland packing 2, and similarly pressed and held by a packing flange 21'.

A first gear (a tubular bevel gear) 22 is connected to the end of the inner tube 1, and the first gear 22 is engaged at right angle with a second gear (a bevel gear) 24 secured to a rotational shaft 23 of the motor. A crankshaft 25 for reciprocating the cylinder (piston body) 5 through the piston shaft 6 is secured to a rotational body 26 secured to the rotational shaft 23 of the motor. Since the first gear 22 and the second gear 24 are the same in number of teeth, when the inner tube 1 rotates once, the piston shaft 6 reciprocates once.

The crankshaft 25 is secured to the rotational body 26, the cylinder 5 is reciprocated by the rotation of the rotational body 26, and when the rotational body 26 rotates once, the crankshaft 25 and the piston shaft 6 reciprocate once, and the inner tube 1 rotates once. The crankshaft 25 may be rotated together with the second gear 24, and therefore, a gear meshed with the second gear 24 may be provided, and it may be secured to the gear provided.

A fixed position of the crankshaft 25 is varied between the center of the rotational body 26 and the outer circumference by means of a stroke adjusting screw 27 whereby the distance for which the piston is reciprocated can be varied to vary the suction and discharge quantities of fluids. It is noted that the suction and discharge quantities can be varied even by varying the rotational speed of the motor.

Pressure and or flow rate of fluids discharged from the through-hole communicated is detected, and the rotational speed of the inner tube 1 and the reciprocating speed of the cylinder 5 are controlled on the basis of a signal detected. One of the pressure and the flow rate of fluids may be detected and controlled, but preferably, both of them are detected to control pressure and flow rate of fluids discharged constant.

According to the present invention, since the sizes of openings of the suction hole and the discharge hole communicated are nearly the same, a fixed quantity of fluids can be sucked and a fixed quantity of fluids can be discharged always to enable almost complete elimination of pulsations.

Further, if design is made so that the volume of the chamber formed by a completely pushed position and a completely pulled position of the cylinder is the same, it is possible to discharge the same quantity of fluids as the suction quantity positively, thus enabling complete elimination of pulsations.

Further, if a bypass passage is provided which communicates with the suction hole of the device body directly or through a seal material from a contact portion between the piston shaft of the cylinder and the rotational body, leakage of hydrogen can be eliminated, and therefore, it can be used as a hydrogen pump for supplying fuel to a fuel cell. In the past, the leakage of hydrogen could not been eliminated, and a hydrogen pump has not been developed. Therefore, the accomplishment of development of a hydrogen pump is an extremely epochal invention.

In the device according to the present invention, a check valve is not used for a pump mechanism, and a piston type is employed, because of which the suction can be performed positively, and the same quantity as the suction quantity can be discharged positively. Accordingly, the device is highly accurate without bringing about pulsations and without loss of energy.

Furthermore, the discharge pressure is high because the principle for mechanically pushing by way of a piston acts, thus enabling use it as a compressor also. Roles of a vacuum pump and a compressor can be performed by a single device, which function was achieved first by the device of the present invention.

In the device according to the present invention, fluids can be discharged quickly or slowly by varying the rotational frequency, and pressure as well as flow rate of fluids discharged can be made constant.

The device according to the present invention can be utilized as a vacuum pump, a high pressure pump, a fixed quantity feed pump or a compressor. The device that can be utilized for the multiple purpose as described has not at all been accomplished heretofore.

According to the present invention, since the sizes of opening of the suction hole and the discharge hole communicated can be made almost the same, a fixed quantity of fluids can be sucked and a fixed quantity of fluids can be discharged always, thus enabling almost completely elimination of pulsations.

The entire disclosure of Japanese Patent Application No. 256391 filed on Aug. 21, 2001, including specification, claims, drawings and summary are incorporated herein by reference in its entirety.

What is claimed is:

1. A suction discharge device for fluids, comprising a device body having a fitting hole, a set comprising a suction hole and a discharge hole, an inner tube fitted rotatably in the fitting hole of the device body, a piston fitted slidably in the said inner tube, and a plurality of through-holes formed in said inner tube, said through-holes of said inner tube each being a slot which is long in a rotational direction and inclined with respect to an axis of the inner tube, the suction hole and the discharge hole of the said set, each being a slot which can partially overlap with said through-hole wherein when one of the through-holes of the said inner tube communicates with the suction hole of the said set, at least one of the other through-holes of the inner tube communicates with a discharge bole of said device body, and when fluid is sucked from the communicated suction hole, said fluid is discharged from the communicated discharge hole.

2. The device according to claim 1, wherein the through-holes of the inner tube, the suction hole, and the discharge hole of the device body are located such that the an overlapped portion of the suction hole and the overlapped portion of the discharge hole move in a direction of the piston during operation of the device.

3. The device according to claim 2, wherein said through-holes, and the suction hole and the discharge hole of said device body all have the same shape and same size, and each is inclined from 30 to 60 with respect to the axis of the inner tube.

4. The device according to claim 3, comprising a plurality of sets, each set of which comprises a suction hole and a discharge hole in the device body, each set of a suction hole and a discharge hole communicating with the through-holes of the inner tube and inclined in the same direction as the through holes.

5. The device according to claim 4, wherein one set of a suction hole and a discharge hole in the device body is positioned on the opposite side of the inner tube from another set.

6. The device according to claim 1, wherein said piston reciprocates simultaneously with the rotation of the said inner tube.

7. The device according to claim 1, wherein said device body is an outer tube or a block body.

8. The device according to claim 5, wherein through-holes on one surface of said inner tube are inclined in the same direction as through holes on opposite surfaces and spaced apart in the sliding direction of the piston.

9. The device according to claim 8, wherein the circumferential length of the slot of 3 said inner tube, and the slots of the suction hole and the discharge hole of said device body are arched slots approximately 9.

10. The device according to claim 1, further includes a bypass passage communicating with a suction port of said device body which extends through said inner tube to a piston shaft of said piston directly or through a seal material.

11. The device according to claim 1, wherein a volume of a chamber formed between said piston and an end wall is fixed to make a quantity of fluids sucked and discharge fixed.

12. The device according to claim 11, wherein a piston shaft projects from one end of said cylinder, and a projected part of said piston shaft is supported slidably on a side wall of the device body to thereby make a quantity of fluids sucked and discharge fixed.

13. The device according to claim 1, wherein pressure and/or flow rate of fluids discharged from said through-hole communicated are detected, and rotational speed of said inner tube and reciprocating speed of said piston are controlled on the basis of a signal detected so that the fluids of fixed pressure or flow rate can be sucked and discharged.

14. The device according to claim 1, further comprising a first gear on one end of said inner tube, a second gear meshing with said first gear, a motor for rotating said second gear, a rotary body that rotates with a rotational shaft of said motor, a crankshaft for reciprocating the piston shaft of said piston secured to said rotary body, wherein when said inner tube rotates once, said piston shaft is reciprocated once.

* * * * *